US007059762B2

(12) United States Patent
Yi

(10) Patent No.: US 7,059,762 B2
(45) Date of Patent: Jun. 13, 2006

(54) THREE-DIMENSIONAL-MOTION-LIKE ROTATIONAL BLEND DEVICE

(76) Inventor: Rongda Yi, Room 604, Block 1, No. 1, Cui Xi Road, Science & Technology Park, Nanshan District, Shenzhen (CN) 518057

( * ) Notice: Subject to any disclaimer, the term of this patent is extended or adjusted under 35 U.S.C. 154(b) by 167 days.

(21) Appl. No.: 10/479,054

(22) PCT Filed: May 28, 2002

(86) PCT No.: PCT/CN02/00357

§ 371 (c)(1),
(2), (4) Date: Nov. 26, 2003

(87) PCT Pub. No.: WO02/098548

PCT Pub. Date: Dec. 12, 2002

(65) Prior Publication Data

US 2004/0151064 A1 Aug. 5, 2004

(30) Foreign Application Priority Data

Jun. 4, 2001 (CN) ..... 01 1 14763

(51) Int. Cl.
*B01F 11/00* (2006.01)

(52) U.S. Cl. ..... 366/208

(58) Field of Classification Search ..... 366/108, 366/112, 111, 217, 218, 208
See application file for complete search history.

(56) References Cited

U.S. PATENT DOCUMENTS 760,664 A * 5/1904 Van der Valk ..... 209/446
2,693,192 A * 11/1954 James ..... 220/559
3,539,156 A * 11/1970 Zipperer ..... 366/110
3,604,564 A * 9/1971 Weyll, Jr. ..... 211/43
3,607,478 A * 9/1971 Henninges et al. ..... 438/747
4,687,108 A * 8/1987 Kernodle, Sr. ..... 211/74
4,702,610 A * 10/1987 Reynolds, Jr. ..... 366/213
4,750,845 A * 6/1988 Nabetani ..... 366/208
4,842,460 A * 6/1989 Schlesch ..... 410/121
5,036,989 A * 8/1991 Carilli ..... 211/74
5,060,151 A * 10/1991 Mikyska et al. ..... 700/90
5,098,663 A * 3/1992 Berthold et al. ..... 422/104
5,238,302 A * 8/1993 Rohan ..... 366/110
5,593,228 A * 1/1997 Tannenbaum ..... 366/209
5,624,185 A * 4/1997 Whisson ..... 366/141
5,639,160 A * 6/1997 Kishimoto ..... 366/208
6,190,032 B1 * 2/2001 Choda ..... 366/208
6,193,892 B1 * 2/2001 Krueger et al. ..... 210/695

* cited by examiner

*Primary Examiner*—Tony G. Soohoo
(74) *Attorney, Agent, or Firm*—Merchant & Gould P.C.

(57) ABSTRACT

The three dimensional shaker consists of a base box with shaking platform, magnetic holders for liquid containers, and a mounted temperature control chamber. The three dimensional rocking movement of the platform can mix and blend liquids thoroughly and rapidly. The strong magnetic holders and temperature-control chamber broadly extend the application of the new shaker in the fields of biology and chemistry. It is suitable for staining, cell culture, extraction, hybridization and particularly for propagation of microorganisms. It can be used for other general blending purposes such as mixing oil and water into emulsified fuel. Furthermore, the unique magnetic holders are able to provide much more convenience and flexibility to change liquid containers of different shapes (round, rectangular) and different sizes compared with conventional clamps or spring holders. Lastly, the removable mounted chamber makes the shaking platform easily adapted to other requirements such as putting inside a $CO_2$ incubator.

3 Claims, 3 Drawing Sheets

THREE-DIMENSIONAL-MOTION-LIKE ROTATIONAL BLEND DEVICE

DESCRIPTION

1. Field of the Invention

This invention pertains to a shaking device for blending and mixing liquid effectively and rapidly. It is particularly useful for cultivation of microorganisms in flasks of various sizes and for mixing liquids with different density such as oil and water.

2. Background and Summary of the Invention

It is necessary for the cultivation of microorganisms in liquid culture media to have a homogeneous media containing as much dissolved oxygen as possible. To achieve this necessities, the conventional incubating shakers operate on either a reciprocating motion or circular orbital motion. Their movement is in one dimension or two dimensions, not three dimensions. The movement in three dimensions can produce a more vigorous shaking. The fixing mechanism for the liquid containers on the shaker platform is traditionally either a clamp or spring holder. Equipped with the conventional shakers are various sizes of clamps or spring holders for different sizes of flasks. When flasks are required to be changed, the clamp holders have to be changed by loosening the screws attached to the clamp holder. It is obviously inconvenient to change flasks from one size to another. For those equipped with a spring holder, the flexibility of changing flasks from one size to another is very limited.

Also, the conventional incubating shakers are not ideal for the application of staining, blotting, hybridization, because of the inconvenience of having to remove clamps or spring holder.

On the other hand, the existing three dimensional shakers can only be used for applications requiring gentle, low-foaming agitation or uniform mixing of lab samples—blotting, hybridizations and DNA extractions, mixing blood samples. These are not designed for cultivation of microorganism as they are not equipped with flask holders.

The objects of the present invention are to overcome the foregoing limitations and disadvantages and to develop an innovative and versatile shaker which moves in three dimensions, with universal and easily removable holders for various containers. That is to integrate all the applications—propagation of microorganisms, blotting membrane, hybridizations, staining and general blending of solutions, preparation of emulsified fuels etc.—into one embodiment.

The three dimensional shaker of this invention can produce much more vigorous swirling than the conventional ones. It can create a much bigger contacting surface between the culture media and air in the flasks than the later. This results in more oxygen being dissolved in the liquid culture media, which facilitates a fast growth of microorganisms or cells.

In this invention, the magnetic holders for containers on the platform can be easily and quickly fixed and removed. It can be adapted for a variety of containers of different shapes and different sizes. This provide an extreme convenience to change the holder when required. With the magnetic holders, the novel shaker can be applied to the growth of microorganisms in flasks at higher speed, even to the preparation of emulsified fuel. Without the magnetic holders, it can be used for blotting, hybridization, DNA extraction, staining and destaining at lower speeds.

The mechanism of the three dimensional rocking movement in this invention differs from that of the conventional one. For the conventional three dimensional shaker, when the shaker is operating, the central supporting shaft to the platform, which is fixed at middle portion by a spherical bearing, is inclined but vertical with respect to the tilted platform. This means every point on the platform including the center will swirl around the central axis, that is the platform will swirl in a nutating rotational movement.

In this invention, the central supporting shaft is vertically located at the center of the base box, therefore, not perpendicular to the tilted platform, which is parallel to the circular inclined plate. Every point on the platform just keep vertically rocking movement and the center of the platform almost remain motionless while the shaker is in operation. This movement is transmitted along the circular orbit. Consequently, this result in much more vigorous mixing than the conventional three dimensional shakers.

BRIEF DESCRIPTION OF THE DRAWINGS

This invention can be better understood with reference to following drawings thereof and corresponding detailed description.

DESCRIPTION OF THE PREFERRED EMBODIMENT

Figure 1:
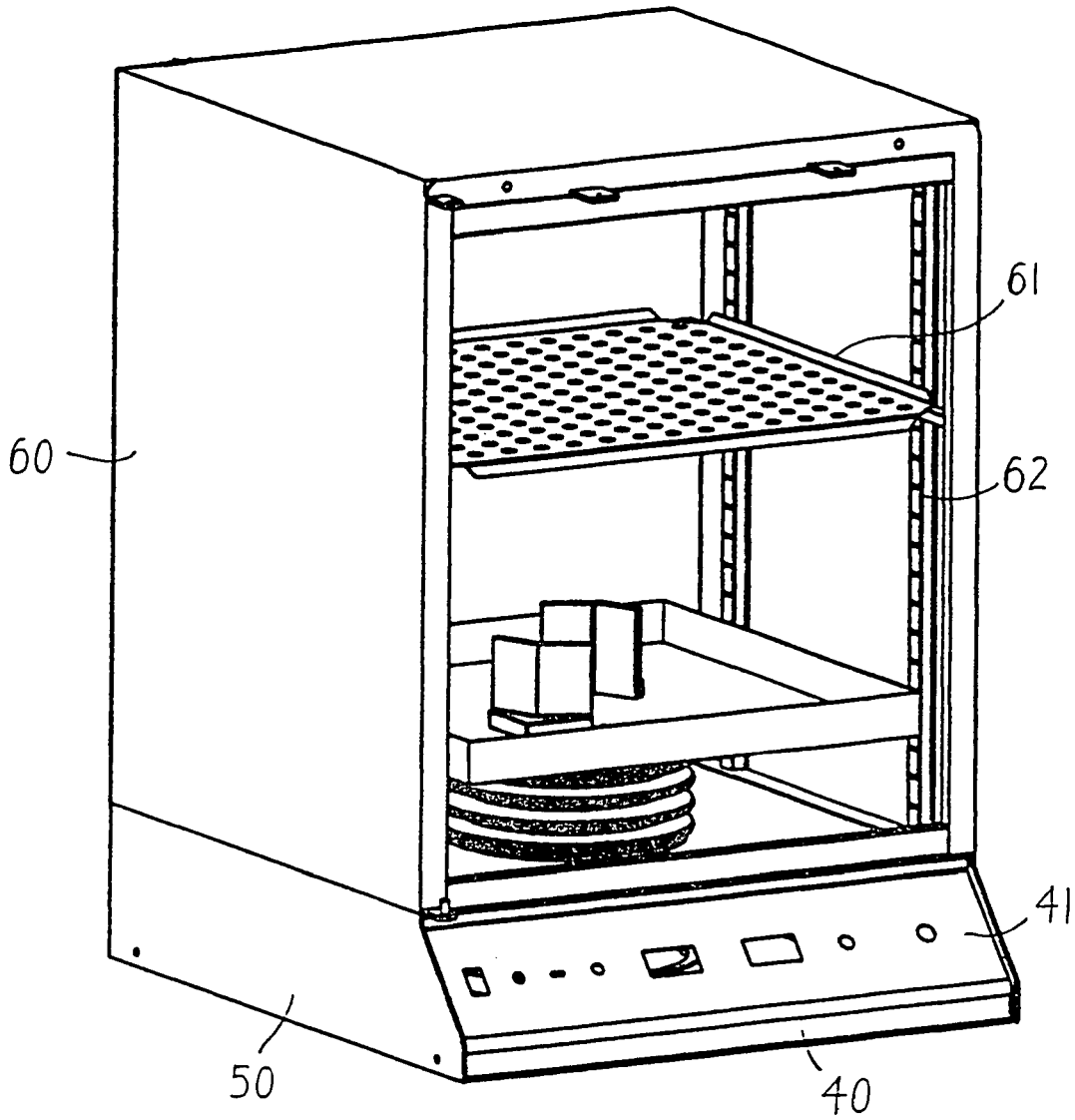
FIG. 1: is a perspective illustration of the shaker constructed in accordance with the principles of this invention.

This innovative and versatile shaking device consists of a base box 40,50 with a container supporting unit 20, which includes a rectangular platform 21 and magnetic holders 22, and a mounted temperature—control chamber 60. Enclosed in the base box 40,50 is the driving mechanism 10.

The driving mechanism 10 works on the following principle; a drive wheel 111, attached to the drive shaft of the motor 11 which is fixed on the corner of the bottom of the base box 40, drives a driven wheel 14 via a direct or indirect way. In this invention, the preferred embodiment is an indirect drive, using a drive belt. The driven wheel 14 is seated and fixed on the lower end of the exterior surface of a rotating shaft 12, which is a generally cylindrical and vertical configuration. A vertical central shaft 13 is fitted onto the interior surface of the rotating shaft 12 by two bearings 181, 182 at the lower and upper ends. This shaft 13, which is not rotatable and sustains the moving parts of the running system and the platform, is fixed at the center of the bottom of the base box 40. Coupled with the top end of the exterior surface of the rotating shaft 12 are specifically configured circular or elliptical inclined plate 15 and a driven disc unit 16 mounted thereon. The inclined plate 15 has a high and low point and three locating holes 151 on the top surface. It contributes to the three dimensional movement and is attached to the top end of the exterior surface of the rotating shaft 12 by 4 screws 152.

The driven disc unit 16, whose top sides is connected to the fixture of the platform, is mounted on the inclined plate 15 by matching the three male screws or pins to the three locating holes on the inclined plate 15. It consists of a ring with internal lower flange 161, a large bearing 183 set into the ring 161, a hat-shaped collar 162 with holes on the edge installed into the large bearing 183, which is used to connect the fixture of the platform 21 by screws, a small spherical bearing 163 fitted into the collar 162. A circular plate 164 mounted onto the inner ring of the spherical bearing 163, is fixed on the top end of the vertical central shaft 13 by a long screw 165.

A vertical compressible rubber spring 30 is attached at the top end to the platform 21 and at the bottom end to the top of the base box 50 by two circular flange plates 31,32 to stop the horizontal movement of the platform 21.

A self-aligning ball bearing 184 and its support bracket 191 is fixed on the frame 19, which is attached to the bottom of base box 40, or underneath the top of the base box 50 directly to support the vertically rotating shaft 12.

When the driven wheel 14 is driven by the motor 11 directly or indirectly, the rotating shaft 12 and the inclined plate 15 will rotate. It will transfer the high and low points along the circular orbit to the platform via bearing 183 in the driven disc unit 16. With the help of tension from the rubber string 30, the self-axis rotation of the platform is hindered. This combination results in an up-and-downward movement with vertical rocking for every point on the platform. Also, this up-and-down movement is transmitted along the circular orbit. Consequently, the liquid in the container on the platform will swirl in three dimensions.

Figure 2:
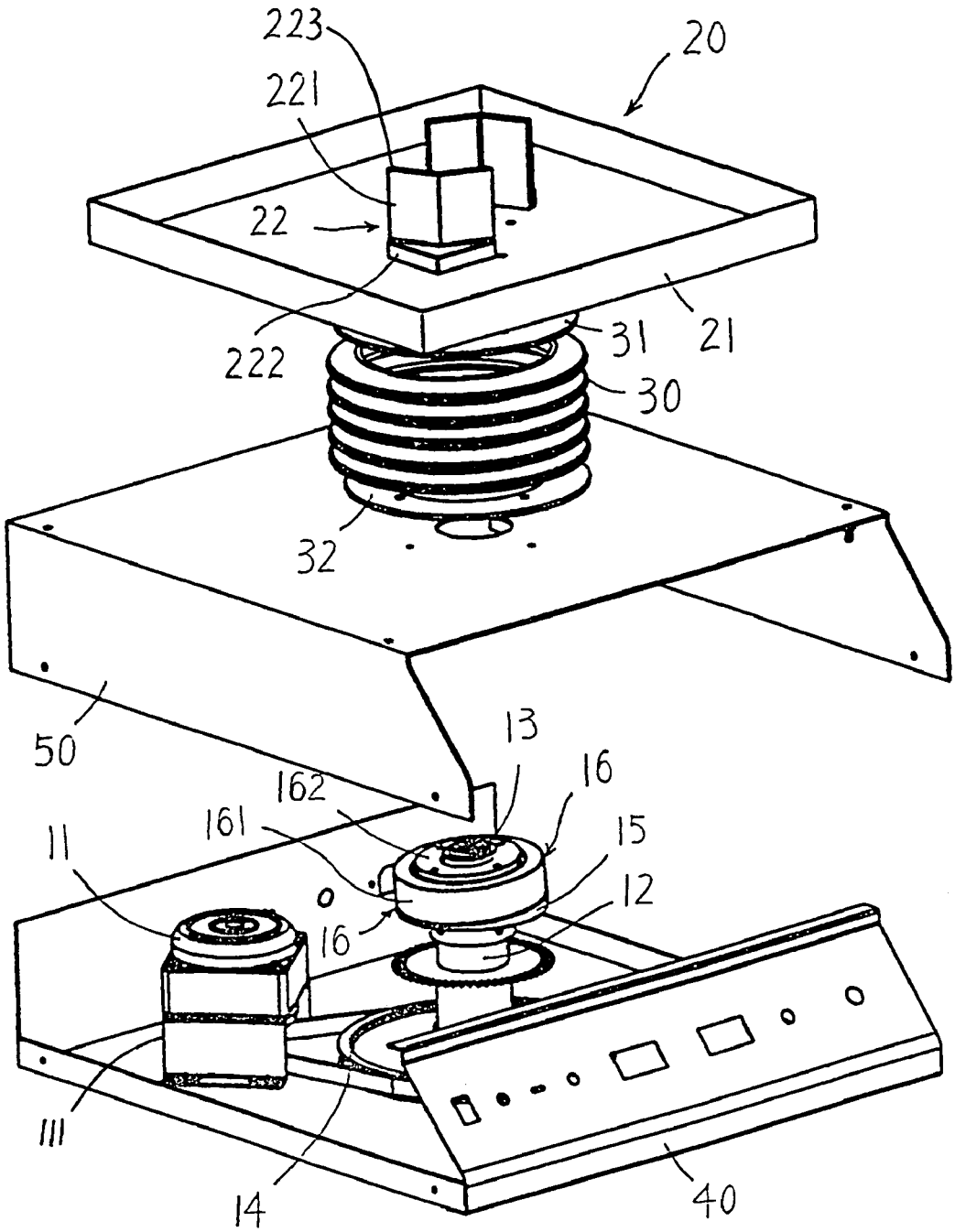
FIG. 2: is a perspective illustration of the base box with shaking platform
Figure 3:
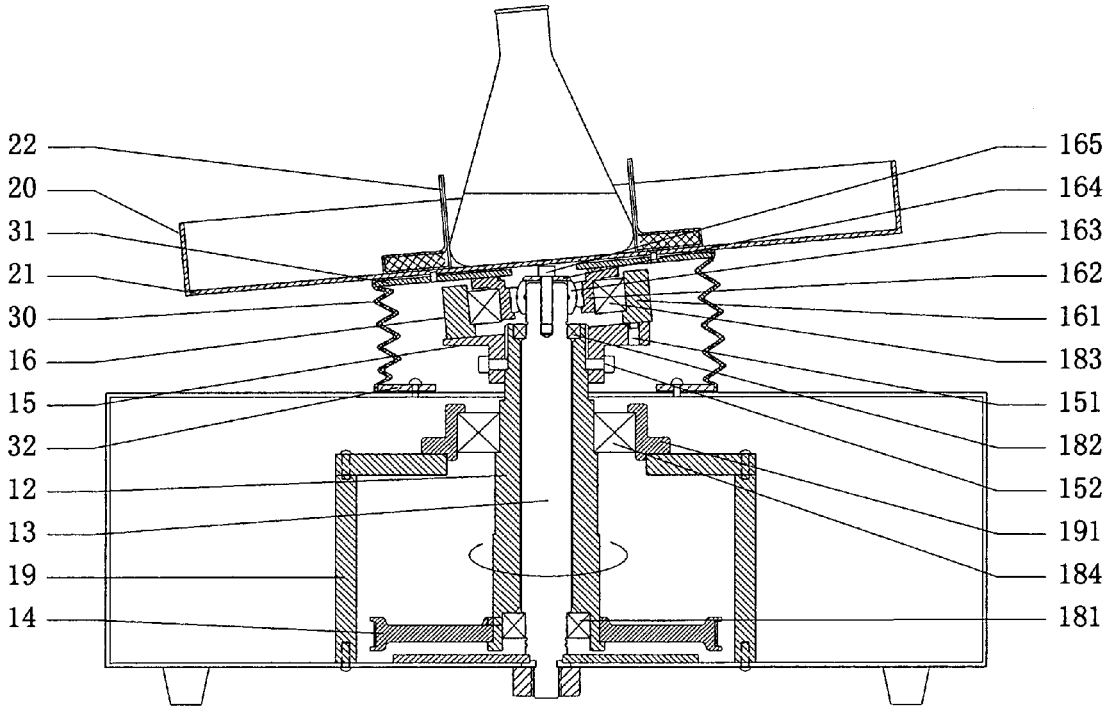
FIG. 3: is a vertical cross section view of the base box with shaking platform

The magnetic holders 22 are a significant aspect of this invention, It consists of two parts: an angled plate fixed on a generally triangular box 221, formed of stainless steel, and a permanent magnet 222 configured and fitted into the triangular box. A layer of rubber 223 is stuck to the inner vertical side of the angled plate to protect and hold the container on the platform as shown in FIG. 2. The magnetic holder can be attached to any place on the platform 21, which is made of iron and covered with a non-slip rubber pad. It is suitable for supporting or holding round or rectangular containers of different sizes. When the magnetic holders are used to hold containers on the platform, the containers can be put in any position desired. Symmetrically place two magnetic holders around the container facing each other, horizontally push the two magnetic holders against the container simultaneously until they are in tight contact with the container. Four, six or eight holders will be needed depending on the load. Obviously, it is extremely convenient to remove the magnetic holder from one place to another when required.

The chamber 60 mounted on the base box 40,50 has a heating/cooling elements, and an air circulation system, which are not shown in the figures. It can be easily detached from the base box when required. For example, putting inside a $CO_2$ incubator for the application of cell suspension cultures. It can accommodate an environment with a consistent temperature for the containers on the platform. The temperature is controlled by the keys on the front panel 41 of a base box via a cable, which connects the chamber and the base box at the rear of each part. Inside the chamber, there are two height-adjustable shelves 61,62 for static incubation whatever the platform is in operation or not.

The foregoing is considered as the preferred embodiment to the basic principles of this invention. Therefore, the countless modification and changes can be derived from it. This invention will not be limited to the application mentioned above. Consequently, all suitable modifications and equivalents can be resorted to fall within the scope of the invention.

The invention claimed is:

1. A shaking apparatus including a driving mechanism, enclosed in a base box with a shaking platform moving in three dimensions, and magnetic holders for liquid containers of various shapes and sizes, the driving mechanism comprising:

a vertical fixed shaft with 2 bearings, one fitted on the top and the other to the bottom, being fixed at the center of the bottom of the base box;

a generally cylindrical and rotating shaft being fitted to the vertical fixed shaft by 2 bearings on the bottom and the top end of the interior surface;

a driven wheel seated and fixed to the bottom end of exterior surface of the rotating shaft;

a drive wheel able to drive the driven wheel directly or indirectly attached to a drive shaft of an electrical motor;

a circular or elliptical inclined plate with three locating holes, having a high and a low points on opposite sides of the top surface, attached to the top end of the exterior surface of the rotating shaft by 4 screws;

a driven disc unit mounted on the inclined plate by three screws or pins, the top side being connected to the fixture of the platform, being fixed on the top of the vertical shaft; and a vertical flexible rubber spring being linked at the bottom to the top side of the base box by an inserted circular plate and at the top to the underside of the platform by another inserted base plate.

2. The shaking apparatus as set forth in claim 1, wherein the driven disc unit having a ring with internal flange, a large bearing set into the ring, a hat-shaped collar with holes on the edge installed into the large bearing and a small spherical bearing seated in the collar, being fixed to the top end of the vertical central shaft by a circular plate and a long screw.

3. The shaking apparatus as set forth in claim 1 wherein the magnetic holders comprise a triangular box containing a strong configured permanent magnet and two vertically angled supporting plates coated on an inner side by a layer of rubber.

* * * * *